United States Patent [19]

Reinherz et al.

[11] Patent Number: 4,743,134

[45] Date of Patent: May 10, 1988

[54] SLIDING LOOSE-LEAF BINDER

[76] Inventors: William Reinherz, 9093 Page Ave. NE., Elk River, Minn. 55330; Thomas Schleich, 155 Gleahaven Rd., Wayzata, Minn. 55391

[21] Appl. No.: 98,233

[22] Filed: Sep. 18, 1987

[51] Int. Cl.[4] ..... B42F 13/16

[52] U.S. Cl. ..... 402/56; 402/55

[58] Field of Search ..... 402/55, 56, 46, 26

[56] References Cited

U.S. PATENT DOCUMENTS

| | | | |
|---|---|---|---|
| 255,901 | 3/1980 | White et al. . | |
| 782,247 | 2/1905 | Hill . | |
| 1,000,649 | 8/1911 | Walker, Jr. | 402/56 |
| 1,774,282 | 8/1930 | Lotter | 402/56 |
| 2,104,046 | 1/1938 | Krag | 402/55 |
| 3,190,293 | 6/1965 | Schneider et al. | 402/30 |
| 4,136,981 | 1/1979 | Stecklow | 402/46 |
| 4,349,289 | 9/1982 | Cordellini | 402/30 |
| 4,349,290 | 9/1982 | Cardellini | 402/55 |
| 4,575,273 | 3/1986 | Gerriet | 402/29 X |
| 4,588,209 | 5/1986 | Zebrowski et al. | 281/45 |

FOREIGN PATENT DOCUMENTS

| | | | |
|---|---|---|---|
| 265525 | 3/1950 | Switzerland | 402/56 |
| 1590929 | 6/1981 | United Kingdom | 402/29 |

*Primary Examiner*—Paul A. Bell

*Attorney, Agent, or Firm*—Orrin M. Haugen; Thomas J. Nikolai; Frederick W. Niebuhr

[57] ABSTRACT

A ring-type binder for retaining loose-leaf sheets of paper is disclosed. The binder has base and top members which are slidably secured to each other. Mounted to each of these members along and projecting from an edge are a plurality of half-ring members. With this configuration the base and top members can be slid between an open position and a closed position in which the half-rings of the top member are mated with the half-rings of the base member.

5 Claims, 1 Drawing Sheet

SLIDING LOOSE-LEAF BINDER

BACKGROUND OF THE INVENTION

I. Field of the Invention: The present invention generally relates to loose-leaf binders and more particularly a loose-leaf binder having pairs of slidably separable receiving rings which are movable between an open and closed position to facilitate the insertion and retention of leaves of paper.

II. Description of the Prior Art: Loose-leaf binders having a plurality of spring-loaded, separable rings associated with the two covers are well known in the prior art. Likewise, various mechanical devices have been developed for permitting ease in opening the rings or for securing the rings in a closed position. A major problem with many loose-leaf binders is that they have a tendency to cause the leaves of paper to bind on the rings as the covers are closed. This can cause damage or tearing of the paper in the binder. Another problem is that it can preclude the covers of the binder from being easily and completely closed. Similarly, traditional three-ring binders do not permit one to easily write on both sides of a sheet of paper. Further, traditional binders cannot be opened fully so that the covers are in face-to-face relationship. This, if possible, conserves on desk space. Thus, there is a real need in the art for a relatively inexpensive loose-leaf ring binder which is (1) easily opened to permit insertion of pre-punched covers, pockets, dividers and sheets of paper, (2) easily and securely closed to retain the paper in the binder, (3) designed to operate in such a manner that the paper does not get bound up with one or the other of the covers of the binder as they are opened and closed, and (4) designed so that the covers can be opened into a face-to-face registration for conservation of desk space.

SUMMARY OF THE INVENTION

The slidable loose-leaf binder design of the present invention includes complementary base and top members, each having three half-rings attached thereto and projecting outwardly from a side edge thereof. Also associated with both the top and the base member is a mating tongue and groove arrangement for maintaining alignment of the half-rings and to prevent jamming of the device as the top and base are slid relative to one another. This tongue and groove arrangement may be comprised of spaced-apart, parallel, laterally extending tracks formed on both the top and base members which are intended to slidably receive barbed projections extending normally from the other member. A key feature of the present invention is that substantially all portions of the top member and base member are located exterior to the inside diameter of the respective half-ring members so that the half-ring members form virtually uninterrupted rings when in the closed position. Further, because of the arrangement of the tracks and barbs, the base member and the top member can slide laterally with respect to each other between a first position where a gap exists between opposed ring halves permitting insertion or removal of paper sheets and a second position where this gap is closed. Detents in the tracks are used to releasibly lock the top member and the base member with the corresponding ring halves in the second or closed position.

OBJECTS

The principal object of the present invention is to provide a loose-leaf binder incorporating base and top members which are slidably connected to one another by mating tracks and barbs, said base member and top member each having associated therewith a plurality of half-rings extending laterally outward therefrom where the corresponding half-rings of the base and top are aligned with one another to form a complete ring when the device is in the closed position.

A further object of the invention is to provide a slidable loose-leaf binder in accordance with the preceding object which is relatively inexpensive to make.

Still a further object of the invention is to provide a slidable loose-leaf binder in accordance with the preceding objects which is designed so that the base and top members reside outside of the inside diameter of the ring members.

Yet another object of the invention is to provide a slidable loose-leaf binder which is in accordance with the preceding objects and which is designed so that the paper does not bind in such a way that it becomes damaged or torn or prevents full closure of the binder.

An additional object of the present invention is to provide a slidable loose-leaf binder in accordane with the preceding objects and which is designed to permit the covers to be opened into a face-to-face registration, so that space on the surface of a desktop is conserved.

These, together with other objects and advantages of the invention, will become more apparent from a review of the description of the preferred embodiment as more fully hereafter described and claimed, reference being had to the accompanying drawings forming a part hereof, wherein like numerals refer to like parts throughout.

DETAILED DESCRIPTION OF THE PREFERRED EMBODIMENT

Figure 1:
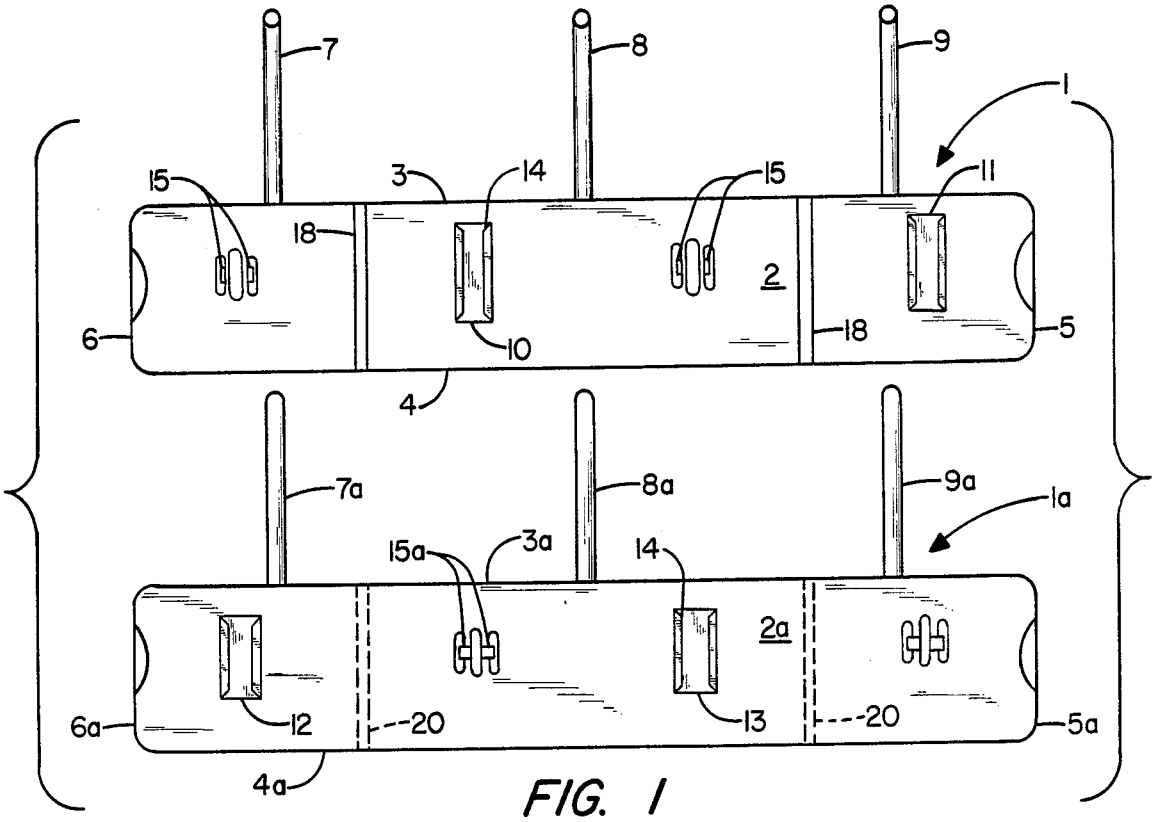
FIG. 1 shows a top view of the base and top members of the slidable loose-leaf binder of the present invention.
Figure 2:
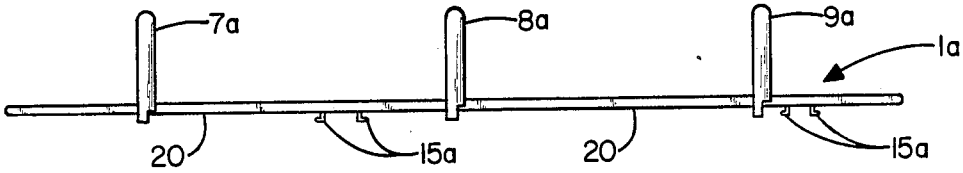
FIG. 2 shows a side view of the top member of the slidable loose-leaf binder of the present invention.

As shown in FIG. 1, the present invention is comprised of a base member 1 and a top member 1*a*. The base member and the top member each have a platform (2 and 2*a* respectively). Platforms 2 and 2*a* are preferably made out of a stiff material such as plastic or metal. The platforms each have an inside edge 3 and 3*a* an opposite outside edge 4 and 4*a*, and end edges 5–5*a* and 6–6*a*. If an additional stiff writing surface is desired, the platforms 2 and 2*a* can be designed so that edges 4, 4*a*, 5, 5*a*, 6 and 6*a* are co-terminus with the corresponding edges of the paper to be inserted into the binder. Platforms 2 and 2*a* support a plurality of half ring members 7, 8, 9 and 7*a*, 8*a*, 9*a*, respectively. The half-ring members have an arcuate shape which is preferably a half-circle. These ring members are fixedly attached at one of their diametric ends to their respective platform at its inside edge 3 or 3*a*.

The unique orientation of the ring members and the platforms permits pre-punched front and back covers to be placed on the rings which can be opened into a face-to-face registration. When the covers are opened in this fashion, the binder of the present invention takes up only about half of the desk space required by more traditional ring binders.

Also associated with each of the platforms 2 and 2*a* are a plurality of tracks as at 10 and 11 on top member 2 and 12 and 13 on base member 2*a*. The tracks are seen to comprise rectangular apertures extending through the thickness dimension of the platforms 2 and 2*a* and having inwardly extending side flanges 14. Projecting normally upward from the platform 2 of the base member 1 and downward from the platform 2*a* of the top member 1*a* are a series of barbs as at 15 and 15*a*. When the device is assembled by overlaying platform 2*a* on platform 2, the barbs 15 or 15*a* on one mate with the corresponding tracks 10–13 on the other to slidably secure the base member 1 to the top member 1*a*.

Figure 3:
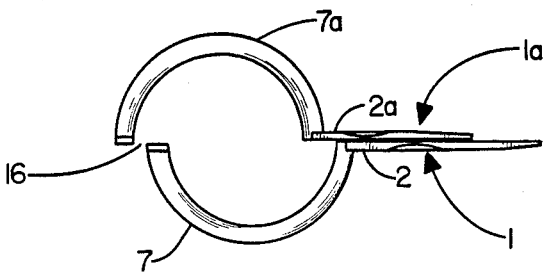
FIG. 3 shows an end view of the binder assembly of the present invention in its open position in which it is capable of receiving new leaves of paper.

Turning to the end view of FIG. 3, the apparatus is shown in its open position. The base member 1 slides so that it is oriented with respect to the top member 1*a* to form a gap 16 between the mating ends of the half-rings 7, 8 and 9 and 7*a*, 8*a* and 9*a* so that pre-punched items such as covers, dividers and leaves of paper can be inserted in the device.

Figure 4:
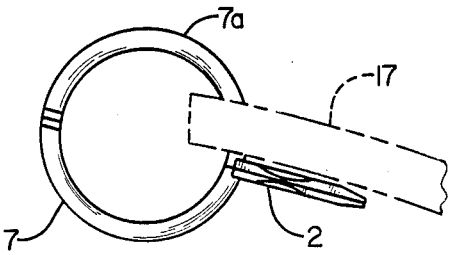
FIG. 4 shows the loose-leaf binder of the present invention in its closed position in which it is capable of retaining pre-punched leaves of paper, covers, dividers and pockets, etc.

FIG. 4 shows the binder in its closed position so that the half-rings 7 and 7*a*, 8 and 8*a*, and 9 and 9*a* are closed to retain the sheave of paper 17, cover members, dividers, and the like, within the binder. As shown in FIG. 4, when the binder is in the closed position, the respective diametric ends of the corresponding half-rings are in contact with each other. This is necessarily so with respect to the diametric ends not fixedly attached to the platforms. It is possible, however, to design a binder so that the diametric ends which are fixedly attached to the platforms do not, in fact, touch without deviating from the invention. To retain the half-rings in their closed position, a recess detent (not shown) associated with the flanges 14 of the tracks 10–13 are provided. The detents of the tracks capture the barbs 15 and 15*a* to prevent base member 1 and top member 1*a* from sliding with respect to each other until the barbs are squeezed toward one another to compress them so that they move out of the recess comprising the detent. While the system of tracks and barbs described above provides a desirable means to slidably secure the two platforms together, other means could be used. For example, the barbs could be replaced by a rivet, stud or pin of acceptable shape and the use of such could ease manufacture and assembly of the device.

When in use, the device is opened and closed by sliding the base member and top member with respect to each other. To prevent sidewise shifting of the top and base members relative to one another, mating tongue and grooves are formed on the respective platforms. The tongues are identified by numerals 18 on platform 2 and the grooves are identified by numeral 20 on platform 2*a*.

The foregoing is considered as illustrative only of the principals of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A loose-leaf binder for retaining leaves of paper comprised of:

(a) a top member including a generally rectangular platform;

(b) a first plurality of half-rings fastened at one diametric end to said platform at spaced locations along one longitudinal edge thereof, said half-rings projecting outwardly from said edge so that substantially all of said platform is located outside of the inside diameter of said half-rings;

(c) a base member including a generally rectangular platform;

(d) a second plurality of half-rings fastened at one diametric end to said platform at spaced locations along one longitudinal edge thereof, said second plurality of half-rings projecting outwardly from said edge of said base member platform so that substantially all of said base member platform is located outside of the inside diameter of said second plurality of half-rings; and (d) means for coupling said top member to said base member such that said half-rings fastened to said top member are in planar alignment with said half-rings fastened to said base member, said means permitting said top and base members to be slid with respect to each other between a first position wherein a gap exists between the free ends of the aligned half-rings for inserting or removing leaves of paper and a second position in which said free ends of said aligned half-rings mate to form a plurality of closed rings which retain said leaves of paper.

2. The loose-leaf binder of claim 1 wherein said means for coupling said top member to said base member includes:

(a) at least one rectangular aperture formed through the thickness dimension of said platforms of said base and top member to define a pair of transversely extending tracks on each such platform; and (b) at least one pair of barbs projecting normally from said platform of said base member and said platform of said top member at locations wherein when said base member and said top member are juxtaposed, the pair of barbs on one platform engage said pair of tracks on the other platform.

3. The loose-leaf binder of claim 2 and further including detent notches formed in said pairs of tracks on each platform for receiving the pair of barbs projecting from said other platform inhibiting relative movement between said platforms when said half-rings on each are mated to form said plurality of closed rings.

4. The loose-leaf binder as in claim 1 and further including a transversely extending groove formed inwardly into one surface of said platform of said top member and a transversely extending tongue on one surface of said base member, said tongue fitting into said groove when said top member and said base member are juxtaposed.

5. The loose-leaf binder as in claim 1 so that when said half-rings fastened to said top member are in planar alignment with said half-rings fastened to said base member, the respective diametric ends of the corresponding half-rings are in contact with each other.

* * * * *